US007103300B2

(12) United States Patent
Kim et al.

(10) Patent No.: US 7,103,300 B2
(45) Date of Patent: Sep. 5, 2006

(54) PROCESS CARTRIDGE FOR IMAGE FORMING APPARATUS

(75) Inventors: Young-min Kim, Suwon-si (KR); Byung-sun Ahn, Suwon-si (KR); Sang-sheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/891,111

(22) Filed: Jul. 15, 2004

(65) Prior Publication Data

US 2005/0147429 A1 Jul. 7, 2005

(30) Foreign Application Priority Data

Jan. 5, 2004 (KR) ..... 10-2004-0000226

(51) Int. Cl.
*G03G 15/00* (2006.01)
*G03G 21/16* (2006.01)

(52) U.S. Cl. ..... 399/111; 399/110

(58) Field of Classification Search ..... 399/110, 399/111

See application file for complete search history.

(56) References Cited

U.S. PATENT DOCUMENTS 5,233,390 A 8/1993 Fujimoto ..... 355/245
6,937,834 B1 * 8/2005 Kanno et al. ..... 399/114

FOREIGN PATENT DOCUMENTS

| | | |
|---|---|---|
| JP | 8-339154 | 12/1996 |
| JP | 08-339154 | * 12/1996 |
| JP | 10-39718 | 2/1998 |
| KR | 91-6145 | 4/1991 |
| KR | 2002-0038529 | 5/2002 |
| KR | 2003-0063132 | 7/2003 |

OTHER PUBLICATIONS

Korean Office Action dated Aug. 10, 2005, in corresponding Korean Patent Application No. 2004-226, filed on Jan. 5, 2004.

* cited by examiner

*Primary Examiner*—Susan Lee
(74) *Attorney, Agent, or Firm*—Staas & Halsey LLP

(57) ABSTRACT

A process cartridge of an image-forming apparatus including a cartridge frame, first and second plates assembled to both sides of the cartridge frame, and first through fourth guiding protuberances arranged on both sides of the cartridge frame, to guide attachment/detachment of the process cartridge to and from a cartridge mounting part formed on a main body frame of the image-forming apparatus. The first and the third guiding protuberances among the four guiding protuberances are formed on the first and the second plates, and the second and the fourth guiding protuberances are formed on both sides of the cartridge frame, respectively, and the first and the second through holes to receive the second and the fourth guiding protuberances in a passing through manner, are formed in the first and the second plates.

19 Claims, 9 Drawing Sheets

PROCESS CARTRIDGE FOR IMAGE FORMING APPARATUS

CROSS-REFERENCE TO RELATED APPLICATIONS

This application claims benefit under 35 U.S.C. § 119 from Korean Patent Application No. 2004-226, filed on Jan. 5, 2004, the entire content of which is incorporated herein by reference.

BACKGROUND OF THE INVENTION

1. Field of the Invention

The present invention relates to an image-forming apparatus and more particularly to a process cartridge of an electrophotographic image-forming apparatus.

2. Description of the Related Art

As is well known, the electrophotographic image-forming apparatus carries out developing of an electrostatic latent image formed on a photoconductive medium by using toner and outputting the developed image, i.e., toner image by transferring the toner image on the photoconductive medium into a printing paper.

Such electrophotographic image-forming apparatus has a photoconductive medium, a light-exposing unit to form an electrostatic latent image on the photoconductive medium, a developing unit to develop an electrostatic latent image, a transferring unit to transfer the developed image onto a paper, a fixing unit to fix the transferred image on the paper, and a paper-feeding/discharging unit.

There are a variety of rollers required to constitute the photoconductive medium and the developing unit, and the rollers are degraded in performance over time, causing image degradation. Accordingly, these rollers require periodic replacement. Additionally, toner is a consumable and should be supplied in time when used up.

The process cartridge is designed to make the replacement process simple and convenient by incorporating elements such as a variety of rollers of the photoconductive medium and the developing unit and a predetermined amount of toners, all having similar lifespan, into one part as a cartridge.

FIG. 1 is a cross-sectional view of an inner structure of the general process cartridge, and FIGS. 2A and 2B are left side and right side perspective views, respectively.

Referring to FIG. 1, a reference numeral 10 refers to a cartridge frame. As shown in FIG. 1, the cartridge frame 10 has a toner reservoir 11 and a toner recovery part 12. The photoconductive medium 20 is positioned between the toner reservoir 11 and the toner recovery part 12 of the frame 10. The developing roller 31 is installed in the cartridge frame 10, maintaining a predetermined developing nip with respect to the photoconductive medium 20. The toner supplying roller 32 is installed in the cartridge frame 10 to supply toner to the developing roller 31. In FIG. 1, the reference numerals 33, 41, and 42 represent an agitator, a charging roller, and an auxiliary charging roller, respectively, and the reference numerals 43, and 44 represent a doctor blade and a cleaning blade, respectively.

As shown in FIGS. 2A and 2B, the process cartridge has first and second plates 50 and 51 joined on both sides of the cartridge frame 10, supporting both ends of the shafts of respective rollers installed in the cartridge frame 10, including the photoconductive medium 20, the developing roller 31, the toner supplying roller 32, the agitator 33, the charging roller 41, and the auxiliary charging roller 42.

First through fourth guiding protuberances 50*a*, 50*b*, 51*a*, and 51*b* are formed on the first and the second plates 50 and 51 to provide guidance during attachment/ detachment of the process cartridge to and from the image-forming apparatus. More particularly, the first and the third guiding protuberances 50*a* and 51*a* are formed in register with the photoconductive medium shaft 20*a*, and the second and the fourth guiding protuberances 50*b* and 51*b* are formed apart from the first and the third guiding protuberances 50*a* and 51*a* by a predetermined distance.

Referring to FIG. 3, a cartridge mounting part 61, on which the process cartridge is mounted, is provided to a main body frame 60 of the image-forming apparatus, and the cartridge mounting part 61 has a guide rail 61*a*, which is inclined a predetermined angle, and an seating part 61*b*, having a substantially semicircular shape.

With such a configuration, when the process cartridge is mounted on the main body frame 60 of the image-forming apparatus, the first through the fourth guiding protuberances 50*a*, 50*b*, 51*a*, and 51*b*, formed on the first and the second plates 50 and 51 of the process cartridge, enter by sliding on the guiding rail 61*a*. Then, as shown in FIG. 4, the first and the third guiding protuberances 50*a* and 51*a* settle down on the seating part 61*b*, whereby the photoconductive medium is normally grounded and mounted.

In dismounting the process cartridge from the main body frame 60 of the image-forming apparatus to replace the process cartridge, the process cartridge is drawn in the direction of the arrow in FIG. 5A, and accordingly, the first and the third guiding protuberances 50*a* and 51*a* are rotated in the direction of the arrow as shown in FIG. 5B with the second and the fourth guiding protuberances 50*b* and 51*b* acting as a hinge point, moving out of the seating part 61*b* of a semicircle shape, so that the process cartridge may be separated through the process as shown in FIG. 5C.

However, since, in the above-described general process cartridge of the image-forming apparatus, the first through the fourth guiding protuberances 50*a*, 50*b*, 51*a*, and 51*b* to guide attachment/detachment of the process cartridge, are integrally formed on the first and the second plates 50 and 51, which are joined to both sides of the cartridge frame 10, the following problems may be generated.

The first and the second plates 50 and 51 are assembled to the cartridge frame 10 by way of a screw fastening operation. Upon assembling of the first plate 51 (e.g., on the right side), a force C to rotate the plate 51 in the screw rotating direction, is generated as shown in FIG. 6A of the cartridge. Such rotational force C of the plate 51 pushes out the developing roller 31 to rotate in the clockwise direction with the seen direction used for the reference, while in contact with a side of the photoconductive medium 20. But, upon assembling of the second plate 50 (left side), as shown in FIG. 6B, since the developing roller 31 is rotated in the counterclockwise direction with the seen direction used for the reference, the rotational direction of the developing roller 31 is forced to rotate in a direction opposite to the screw rotating direction. Namely, a force D is generated, causing a rotation of the plate 50 toward the direction in which the developing roller 31 is separated from the photoconductive medium 20.

Such rotation of the first and the second plates 50 and 51 in the assembling process causes non-uniformity in right and left developing nips between the photoconductive medium 20 and the developing roller 31. This results in, irregular densities in right and left portions of an image and a difference in developing amounts at right and left sides. Accordingly, lifespans of right and left parts, including the roller in the cartridge, are different, and image output becomes irregular. In a serious case, the photoconductive medium 20 and the developing roller 31 partially disengage, causing the white-void on the image.

Also, the rotation of the plates 50 and 51 may generate deformation of the cartridge frame 10 and may cause aging of the photoconductive medium 20 and the roller 31, whereby serious image problem may result.

Also, in the conventional process cartridge, upon assembling, the plates 50 and 51 are assembled with a photoconductive medium shaft 20*a* used for the reference, but aligning all parts to be assembled using such one reference point is difficult.

Also, there is no way to check the error if the dimensions of the projecting portions of the plates 50 and 51, such as the distance between the first guiding protuberance 50*a* and the second guiding protuberance 50*b* or the distance between the third guiding protuberance 51*a* and the fourth guiding protuberance 51*b* are formed inaccurately during the manufacturing process, and the process cartridge may be incorrectly mounted on the main body frame of the image-forming apparatus.

SUMMARY OF THE INVENTION

An aspect of the present invention therefore, provides a process cartridge of an image-forming apparatus, capable of preventing aging of a part by making plates which are not rotated upon assembling of a first plate and a second plate to the cartridge frame.

Another aspect of the present invention provides a process cartridge of an image-forming apparatus, capable of performing assembling of a plate by providing two assembling reference points upon the assembly of the plate, and resolving a falsely mounting problem of the process cartridge by allowing a false measurement during an assembling process to be checked in case the plate is manufactured on the basis of a false measurement.

The foregoing and/or other aspects and advantages are substantially realized by providing a process cartridge of an image-forming apparatus of the present invention, which comprises: a photoconductive medium; a developing roller to deliver toner to the photoconductive medium; a cartridge frame to receive and to support the developing roller; first and second plates joined, respectively, to both sides of the cartridge frame; and first through fourth guiding protuberances arranged on both sides of the cartridge frame, to guide attachment/detachment of the process cartridge to and from a cartridge mounting part formed on a main body frame of the image-forming apparatus, wherein two of the guiding protuberances are installed on both sides of the cartridge frame, respectively, and through holes to receive the two guiding protuberances installed on the cartridge frame are formed, respectively, on the first and the second plates.

The other two guiding protuberances among the four guiding protuberances are installed on the first and the second plates, adjacent to a shaft of the photoconductive medium.

The cartridge mounting part has a guide rail and a seating part, and the two guiding protuberances formed on the first and the second plates cooperate with a mounting guide settled down on the seating part, and the two guiding protuberances formed on the cartridge frame cooperate with a separating guide that plays a role as a rotation point upon separation.

According to an embodiment of the present invention, the process cartridge of the image-forming apparatus comprises: a charging roller to change the photoconductive medium; a toner supplying roller to supply toner to the developing roller; and a doctor blade to control toner supplied to the developing roller to a predetermined thickness.

Also, the process cartridge of the image-forming apparatus of the present invention may further comprise an agitator to agitate toner stored in the process cartridge.

Also, the above aspects of the present invention are realized by providing a process cartridge of an image-forming apparatus, having a cartridge frame; and first and second plates assembled to both sides of the cartridge frame, and mounted, in a detachable manner, on a cartridge mounting part formed on a main body frame of an image-forming apparatus. The process cartridge comprises: first through fourth guiding protuberances arranged on both sides of the cartridge frame, to guide attachment/detachment of the process cartridge to and from the cartridge mounting part, wherein the first and the third guiding protuberances are installed on the first and the second plates, and the second and the fourth guiding protuberances are installed on both sides of the cartridge frame, respectively, and first and second through holes to receive the second and the fourth guiding protuberances are formed on the first and the second plates.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
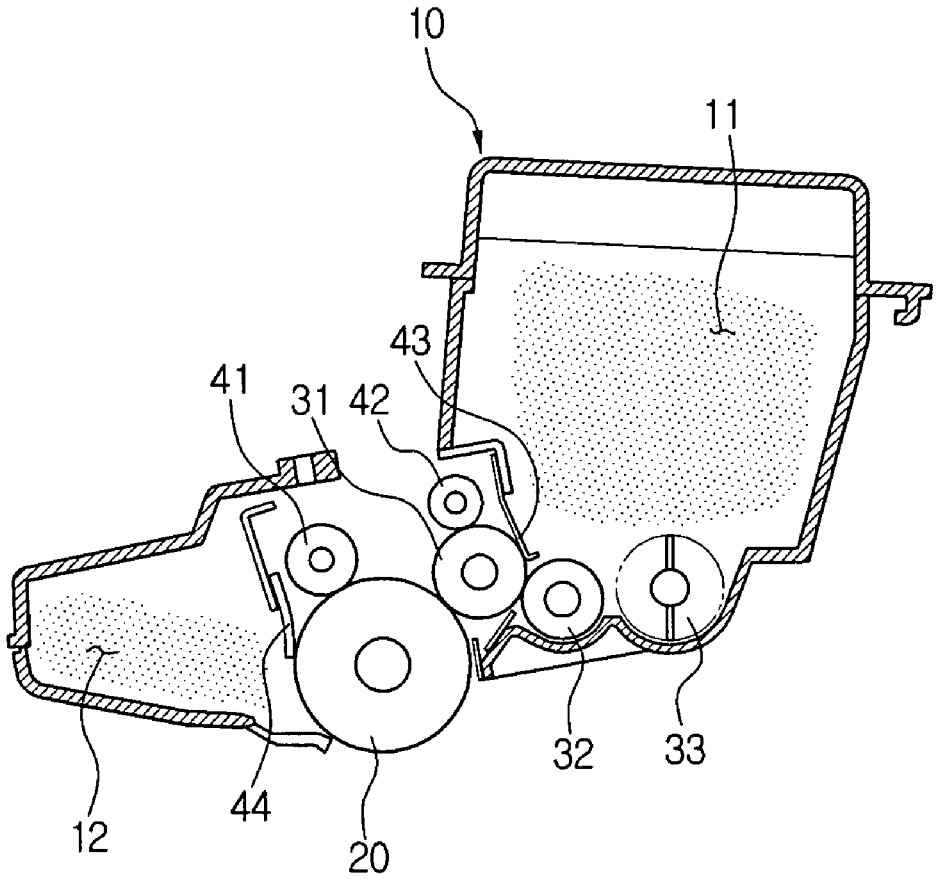
FIG. 1 (PRIOR ART)
FIG. 1 is a schematic, cross-sectional view of a general process cartridge of the image-forming apparatus.
Figure 2A:
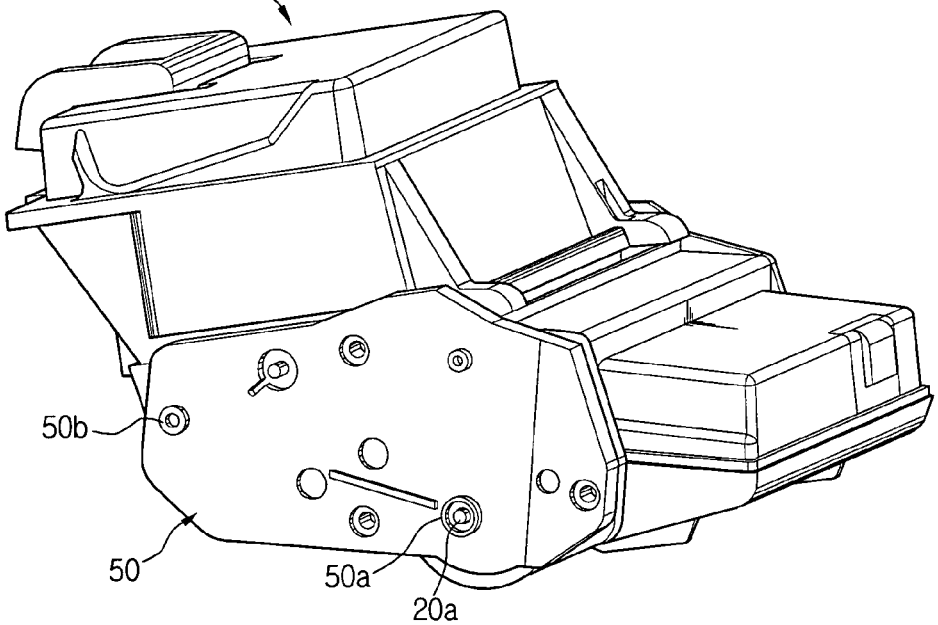
FIG. 2A (PRIOR ART)
FIGS. 2A and 2B are left and right perspective views of the process cartridge shown in FIG. 1.
Figure 2B:
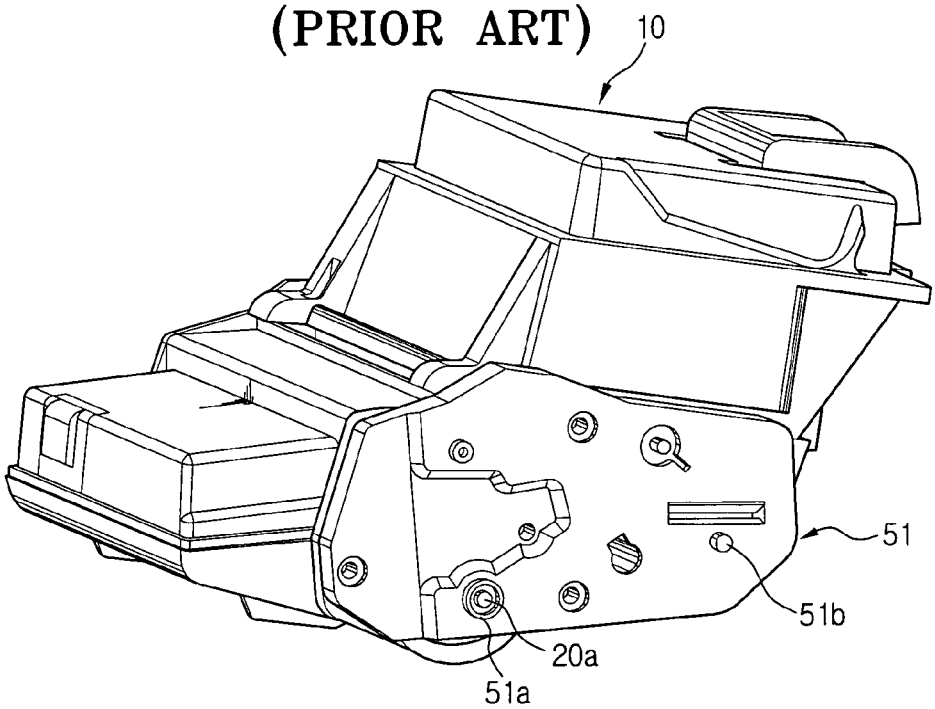
FIG. 2B (PRIOR ART)

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
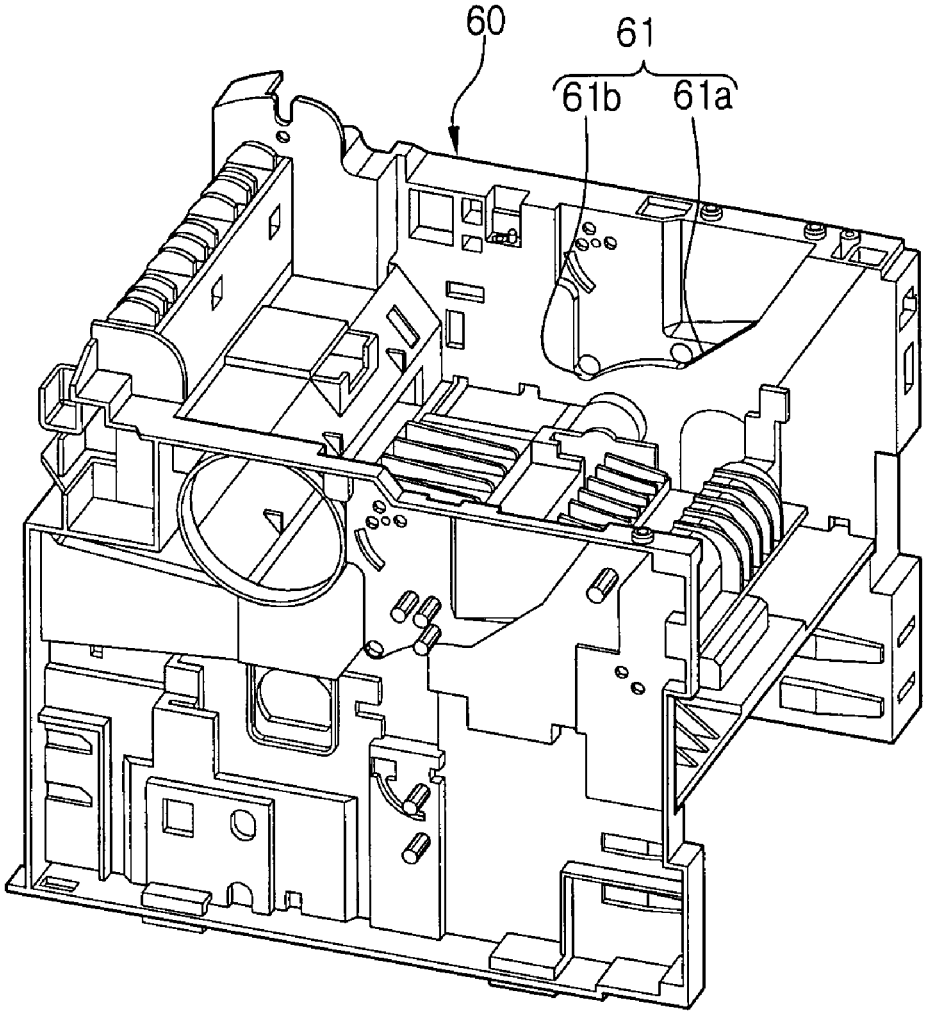
FIG. 3 (PRIOR ART)
FIG. 3 is a perspective view of a main body frame structure of the general image-forming apparatus.
Figure 4:
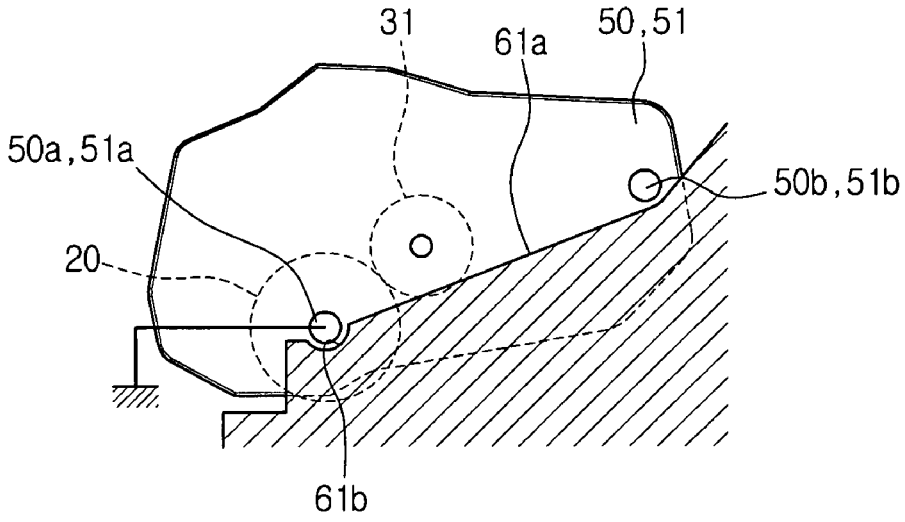
FIG. 4 (PRIOR ART)
FIG. 4 is a view schematically showing the process cartridge being mounted on the main body frame of the image-forming apparatus.
Figure 5A:
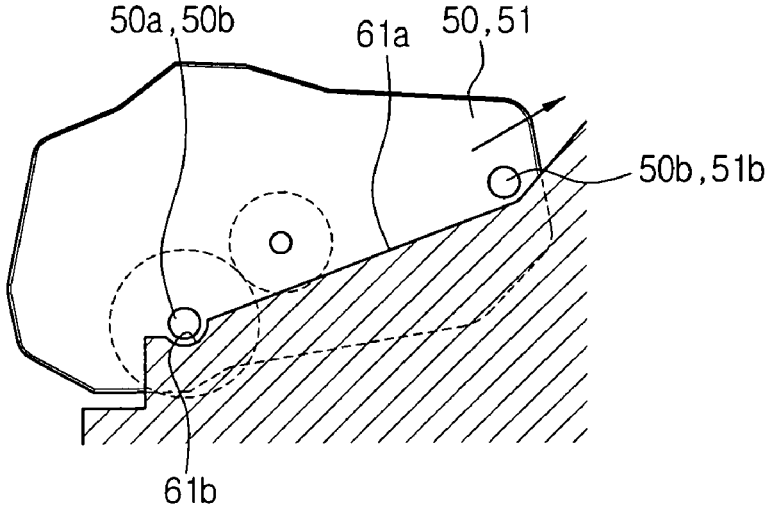
FIG. 5A (PRIOR ART)
FIGS. 5A through 5C are views schematically showing a process in which the process cartridge is separated from the main body frame of the image-forming apparatus.
Figure 5B:
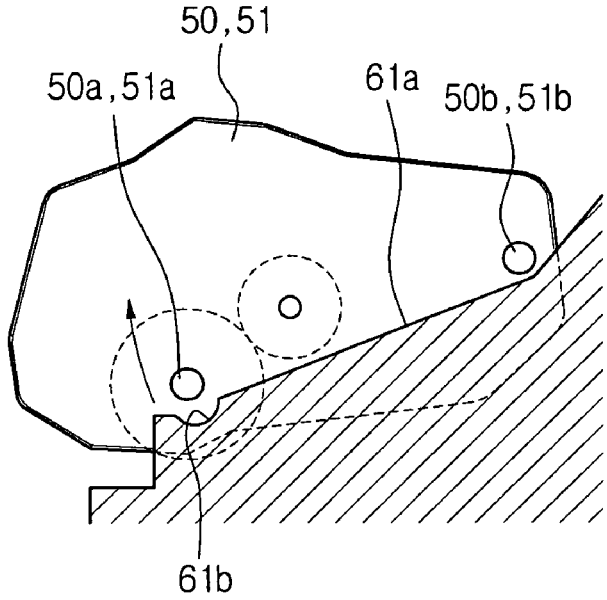
FIG. 5B (PRIOR ART)
Figure 5C:
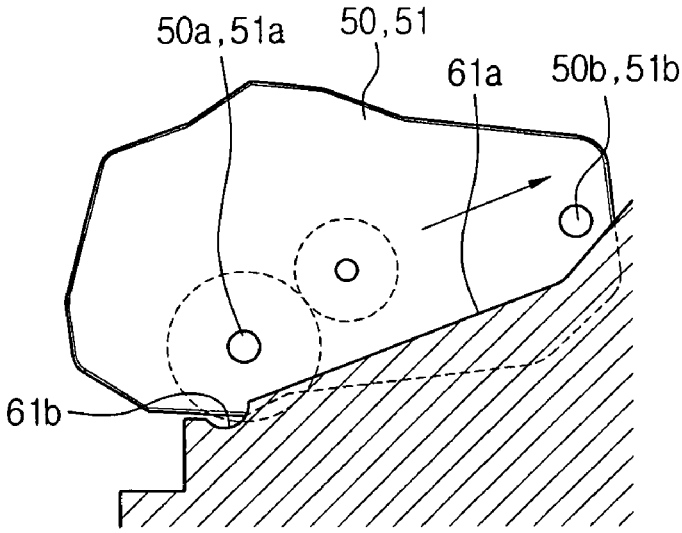
FIG. 5C (PRIOR ART)
Figure 6A:
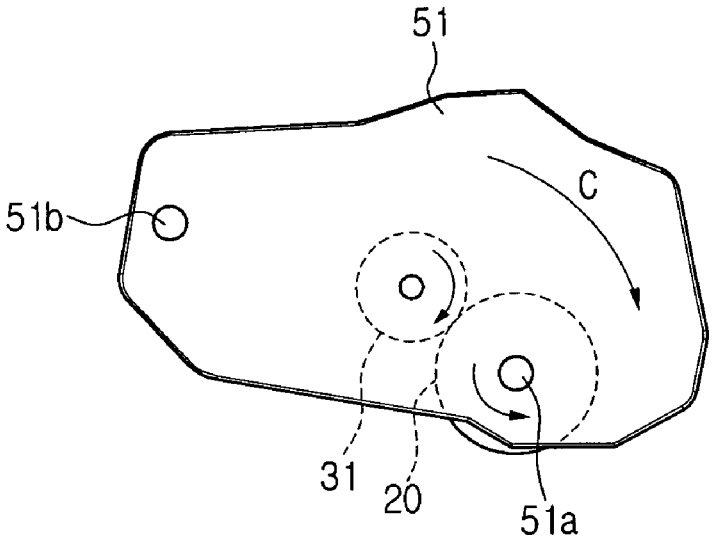
FIG. 6A (PRIOR ART)
FIGS. 6A and 6B are views to explain problems of the conventional process cartridge.
Figure 6B:
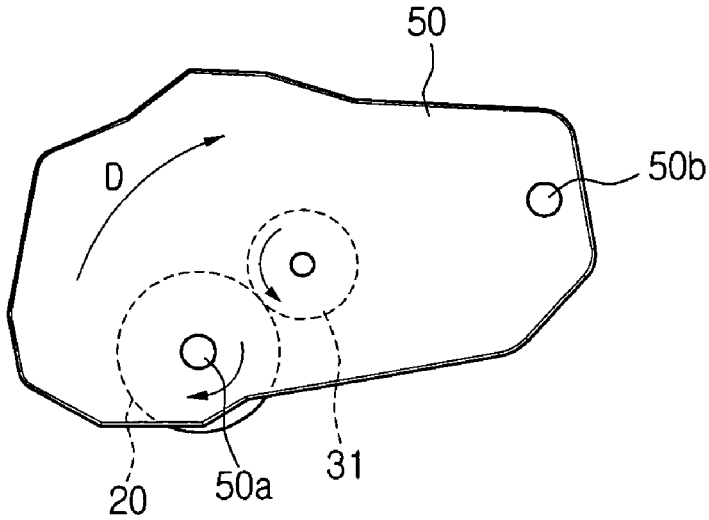
FIG. 6B (PRIOR ART)

As shown in FIGS. 7A, 7B, 8A, 8B, a process cartridge of the image-forming apparatus according to an embodiment of the present invention comprises four guiding protuberances 50*a*, 50*b*, 51*a*, 51*b* to guide the process cartridge when the process cartridge is attached/detached to and from the cartridge mounting part 61 (refer to FIG. 3) of the main body frame 60 of the image-forming apparatus. In an embodiment of the invention, among the four guiding protuberances 50*a*, 50*b*, 51*a*, and 51*b*, the second and the fourth guiding protuberances 50*b*, and 51*b* are formed on the cartridge frame 10, and the other two protuberances, i.e., the first and the third guiding protuberances 50*a* and 51*a* are formed on the first and the second plates 50 and 51 as in the conventional art.

According to the embodiment of the present invention in which the second and the fourth guiding protuberances 50*b* and 51*b* are formed on both sides of the cartridge frame 10, the first and the second through holes 50*c* and 51*c* are formed respectively on the first and the second plates 50 and 51, which are assembled to both sides of the cartridge frame 10. The first and the second through holes 50*c* and 51*c* receive the guiding protuberances 50*b* and 51*b* which pass through the first and second through holes 50*c* and 51*c*.

Figure 7A:
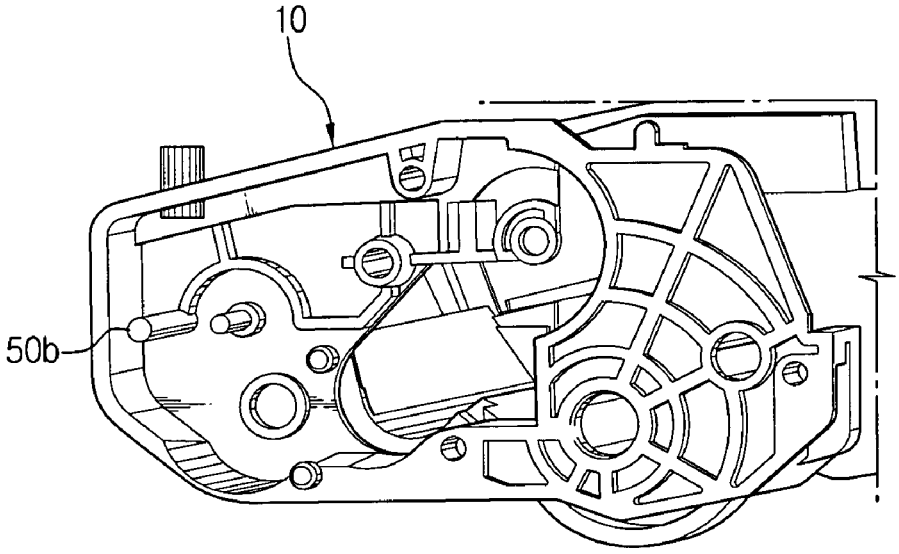
FIGS. 7A and 7B are left and right side views of the cartridge frame, which is a crucial part of the process cartridge of the image-forming apparatus according to an embodiment of the present invention.
Figure 7B:
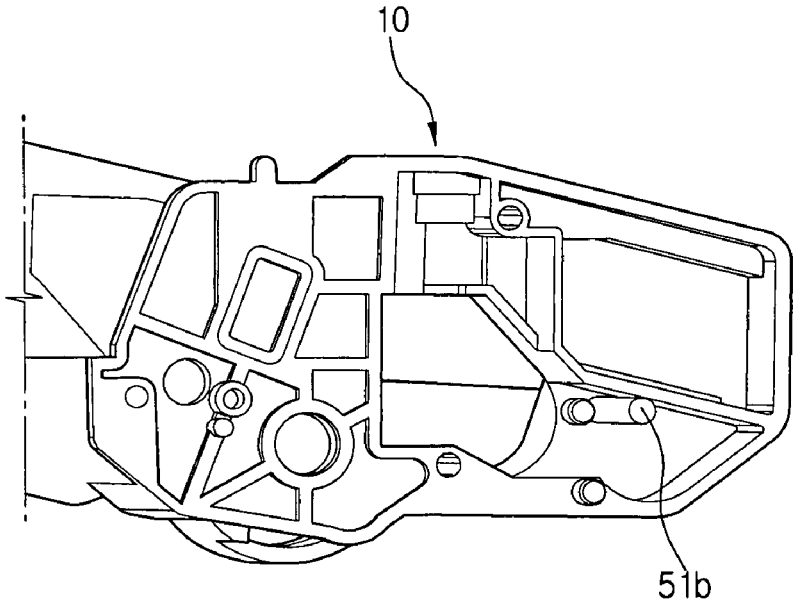

The cartridge frame 10 includes a toner reservoir 11 and a toner recovery part 12 (refer to FIG. 1), and receives and supports a variety of rollers including the photoconductive medium 20 and the developing roller 31. Therefore, on both sides of the cartridge frame, a plurality of supporting structures to mount a variety of the rollers is provided as shown in FIGS. 7A and 7B. The second and the fourth guiding protuberances 50*b* and 51*b* are externally projected in a predetermined height on both sides of the cartridge frame 10, need not be symmetrical to each other, and are arranged in proper positions depending on a manner that the image-forming apparatus is employed. Such second and fourth guiding protuberances 50*b* and 51*b* may be formed by injection-molding integrally on the cartridge frame 10, or may be separately formed and joined.

Figure 8A:
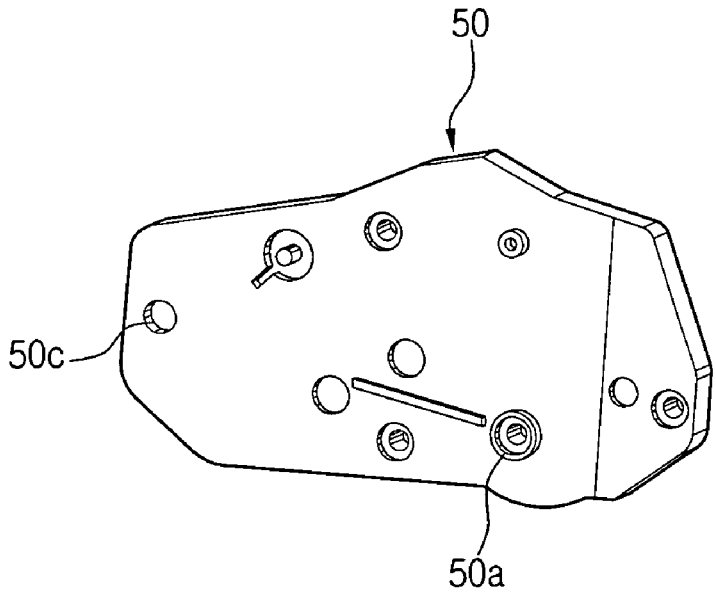
FIGS. 8A and 8B are views of a first plate and a second plate that correspond to both sides of the cartridge frame shown in FIGS. 7A and 7B.
Figure 8B:
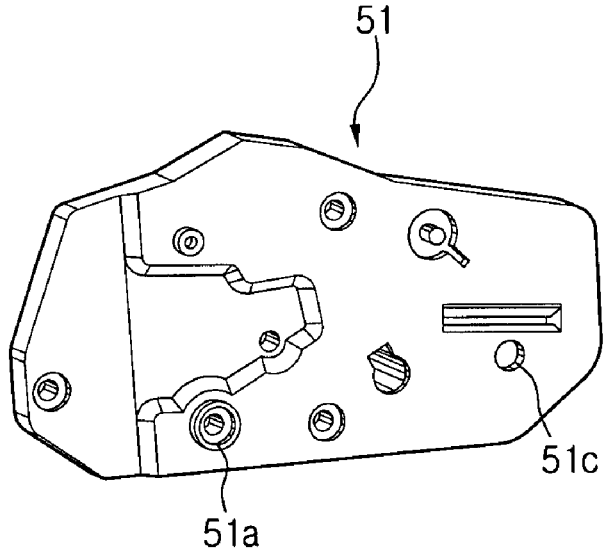

As shown in FIGS. 8A and 8B, the first and the second plates 50 and 51 have a plurality of supporting parts to support the shafts of a variety of rollers such as the photoconductive medium 20 and the developing roller 31 received in the cartridge frame 10. The first and the third guiding protuberances 50*a* and 51*a* may be formed adjacent to the photoconductive medium shaft 20*a*. In the example, the first and the third guiding protuberances 50*a* and 51*a* are so formed as to enclose the photoconductive medium shaft 20*a*, and the first and the second through holes 50*c* and 51*c* are formed, respectively, on the position that is spaced a predetermined interval from the first and the third guiding protuberances 50*a* and 51*a*.

Figure 9A:
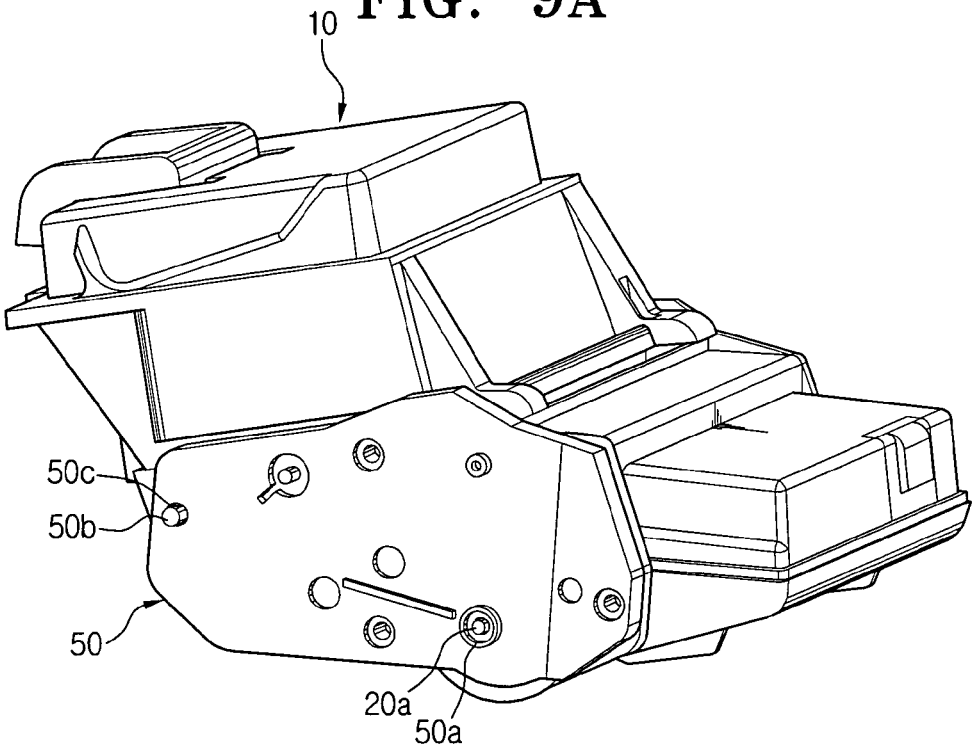
FIGS. 9A and 9B are left and right side perspective views illustrating the first and the second plates being assembled to both sides of the cartridge frame.
Figure 9B:
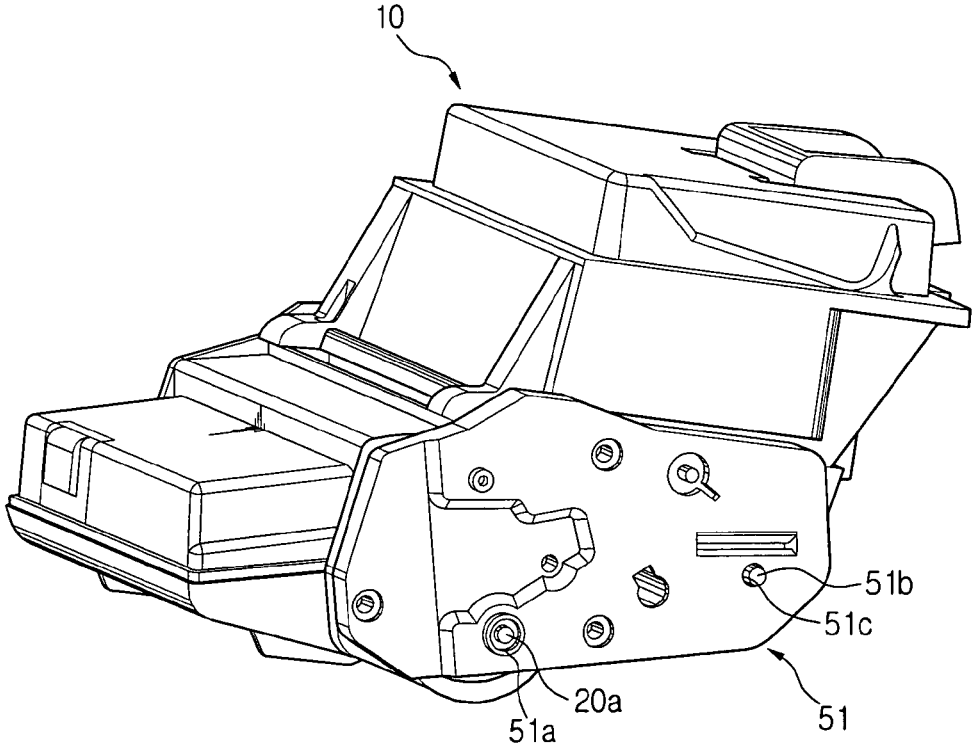

FIGS. 9A and 9B are left and right perspective views illustrating a state in which the first and the second plates are assembled to both sides of the cartridge frame. As is apparent from FIGS. 9A and 9B, the second and the fourth guiding protuberances 50*b* and 51*b* pass through the first and the second through holes 50*c* and 51*c* of the first and the second plates 50 and 51, and the photoconductive medium shaft 20*a* passes through the photoconductive medium shaft supporting part.

The assembling of the process cartridge of the image-forming apparatus, having the foregoing construction according to one certain embodiment of the present invention is performed in the following manner.

First, a variety of rollers including the photoconductive medium and the developing roller, are mounted on the cartridge frame 10, and toner is filled in the toner reservoir. Thereafter, the first and the second plates 50 and 51 are assembled to both sides of the cartridge frame 10. At this point, the plates 50 and 51 are temporarily assembled in such a way that the second and the fourth guiding protuberances 50*b* and 51*b* of the cartridge frame 10 are fit in the through holes 50*c* and 51*c*, respectively, and the photoconductive medium shaft 20*a* is fit in the photoconductive medium shaft supporting part. Namely, as shown in FIGS. 9A and 9B, required screw fastening is performed under temporary assembling state where the plates 50 and 51 are supported by both the guiding protuberances 50*b* and 51*b* and the photoconductive medium shaft 20*a*.

Therefore, the phenomenon that the plates 50 and 51 are rotated upon screw fastening as was done in the conventional art, is not generated, and since two assembling reference points are used, the corresponding positions of the cartridge frame 10 and the plates 50 and 51 are easily aligned, whereby assembling efficiency can be improved. Also, since there exist two guiding protuberances 50*b* and 51*b* on the cartridge frame 10 and there exist on the plates 50 and 51 the through holes 50*c* and 51*c* corresponding to the above two guiding protuberances 50*b* and 51*b*, if measurements of the cartridge frame 10 and the plates 50 and 51 are not exact, assembling may not be possible. Thus, the present invention provides verification of a measurement error.

Accordingly, since the plates are not rotated upon assembling of the plates, aging of the parts due to rotation of the plates as was frequent in the conventional art, may be prevented.

Also, since the two assembling reference points are used, assembling of the plate is performed in a very simple manner and verification of part's error is naturally performed upon assembling of the plate, the problem of falsely mounting the process cartridge, which has been generated due to a error of the part in the conventional art, may be fundamentally resolved.

Accordingly, since the first and the second plates are screw-fastened under temporary assembled state with the two points including the guiding protuberance installed on the cartridge frame and the photoconductive medium shaft used for the reference points, the plate is not rotated and the assembling process is swiftly performed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A process cartridge of an image-forming apparatus, comprising:

a photoconductive medium;

a developing roller to deliver toner to the photoconductive medium;

a cartridge frame to receive and support the developing roller;

a first and a second plates joined, respectively, to both sides of the cartridge frame;

first through fourth guiding protuberances arranged on both sides of the cartridge frame, to guide attachment/detachment of the process cartridge to and from a cartridge mounting part formed on a main body frame of the image-forming apparatus;

two guiding protuberances among the four guiding protuberances being formed on both sides of the cartridge frame, respectively; and through holes to receive the two guiding protuberances being formed respectively on the first and the second plates.

2. The cartridge frame as claimed in claim 1, wherein the other two guiding protuberances among the four guiding protuberances are installed on the first and the second plates, adjacent to a photoconductive medium shaft.

3. The cartridge frame as claimed in claim 2, wherein the cartridge mounting part has a guide rail and a seating part, and the two guiding protuberances formed on the first and the second plates relate to a mounting guide settled down on the seating part, and the two guiding protuberances formed on the cartridge frame relate to a separating guide that plays a role as a rotation point upon separation.

4. The cartridge frame as claimed in claim 2, further comprising:

a charging roller to charge the photoconductive medium;

a toner supplying roller to supply toner stored in the cartridge frame to the developing roller; and a doctor blade to control toner supplied to the developing roller to a predetermined thickness.

5. The cartridge as claimed in claim 4, further comprising an agitator to agitate toner stored in the process cartridge.

6. A process cartridge of an image-forming apparatus having a cartridge frame; and a first and a second plates assembled to both sides of the cartridge frame, and mounted, in a detachable manner, on a cartridge mounting part formed on a main body frame of the image-forming apparatus, the process cartridge comprising:

first through fourth guiding protuberances arranged on both sides of the cartridge frame, to guide attachment/detachment of the process cartridge to and from the cartridge mounting part, wherein the first and the third guiding protuberances are installed on the first and the second plates, and the second and the fourth guiding protuberances are installed on both sides of the cartridge frame, respectively, and a first and a second through holes to receive the second and the fourth guiding protuberances are formed on the first and the second plates.

7. A process cartridge of an image-forming apparatus, including a photoconductive medium, a developing roller to deliver toner to the photoconductive medium, a cartridge frame, having a cartridge mounting, to receive and support the developing roller, the cartridge comprising:

first and second plates joined, respectively, to both sides of the cartridge frame;

first, second, third, and fourth guiding protuberances on both sides of the cartridge frame, to guide the process cartridge into and out from the cartridge mounting, two of which being formed on either sides of the cartridge frame, respectively; and through holes, in the first and second plates, to receive the two guiding protuberances not formed on either sides of the cartridge frame.

8. The cartridge according to claim 7, further comprising a photoconductive medium shaft to support a photoconductive medium, wherein the other two guiding protuberances among the four guiding protuberances are installed on the first and the second plates, adjacent to the photoconductive medium shaft.

9. The cartridge according to claim 8, wherein the cartridge mounting comprises:

a guide rail; and a seating part, wherein the two guiding protuberances, formed on the first and the second plates, cooperate with a mounting guide on the seating part, and the two guiding protuberances formed on the cartridge frame cooperate with a separating guide to serve as a rotation point upon separation of the process cartridge and the cartridge mounting.

10. The cartridge according to claim 8, further comprising:

a charging roller to charge the photoconductive medium;

a toner supplying roller to supply toner stored in the cartridge frame to the developing roller; and a doctor blade to control toner supplied to the developing roller to a predetermined thickness.

11. The cartridge according to claim 10, further comprising an agitator to agitate toner stored in the process cartridge.

12. The cartridge according to claim 8, wherein the cartridge frame includes a toner reservoir to contain a reserve of toner, and a toner recovery part to recover used toner.

13. The cartridge according to claim 12, further comprising a photoconductive medium and a developing roller, wherein the cartridge frame receives and supports the photoconductive medium and the developing roller.

14. The cartridge according to claim 7, wherein the two guiding protuberances formed on the cartridge frame are externally projected in a predetermined height on the sides of the cartridge frame.

15. The cartridge according to claim 14, wherein the second and fourth guiding protuberances need are asymmetrical to each other.

16. The cartridge according to claim 7, wherein the first and second plates comprise a plurality of supporting parts to support roller shafts.

17. A method of assembling an image forming apparatus with a cartridge, comprising:

providing a cartridge frame, including first, second, third, and fourth guiding protuberances, into which rollers are included; and assembling first and second plates, including through holes, to first and second sides of the cartridge frame, respectively, such that two of the guiding protuberances fit into the through holes.

18. The method according to claim 17, further comprising screw fastening when the first and second plates are assembled to the first and second sides of the cartridge frame, respectively.

19. The method according to claim 17, further comprising fitting a photoconductive medium shaft into a photoconductive medium shaft supporting part when the first and second plates are assembled to the first and second sides of the cartridge frame, respectively.

* * * * *